US008863836B2

(12) United States Patent
Coludrovich, III

(10) Patent No.: US 8,863,836 B2
(45) Date of Patent: Oct. 21, 2014

(54) SYSTEMS AND METHODS FOR LOGGING CASED WELLBORES

(75) Inventor: Earl J. Coludrovich, III, Missouri City, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 599 days.

(21) Appl. No.: 12/754,751

(22) Filed: Apr. 6, 2010

(65) Prior Publication Data

US 2011/0240302 A1 Oct. 6, 2011

(51) Int. Cl.

| | |
|---|---|
| ***E21B 47/00*** | (2012.01) |
| ***E21B 37/00*** | (2006.01) |
| ***E21B 47/12*** | (2012.01) |

(52) U.S. Cl.

CPC ..... *E21B 37/00* (2013.01); *E21B 47/12* (2013.01); *E21B 47/124* (2013.01)

USPC ..... 166/250.01; 166/253.1; 166/254.2; 166/250.14; 166/336

(58) Field of Classification Search

USPC ..... 166/250.01, 253.1, 254.2, 250.14, 336, 166/311, 312, 242.9, 285, 170–173, 177.4; 367/35; 181/105

See application file for complete search history.

(56) References Cited

U.S. PATENT DOCUMENTS

| | | | | |
|---|---|---|---|---|
| 3,312,280 A | | 4/1967 | Koplin | |
| 3,455,387 A | | 7/1969 | Peters | |
| 3,799,874 A | | 3/1974 | Parker | |
| 4,036,301 A | | 7/1977 | Powers et al. | |
| 4,069,870 A | | 1/1978 | Gallus | |
| 4,120,736 A | | 10/1978 | Childs et al. | |
| 4,149,900 A | | 4/1979 | Childs et al. | |
| 4,279,299 A | | 7/1981 | Shuck | |
| 4,372,384 A | | 2/1983 | Kinney | |
| 4,551,823 A | * | 11/1985 | Carmichael et al. | 367/35 |
| 4,747,452 A | | 5/1988 | Clark | |

(Continued)

FOREIGN PATENT DOCUMENTS

| | | | |
|---|---|---|---|
| WO | 9910624 | 3/1999 | |
| WO | 2008047107 | 4/2008 | |
| WO | WO 2008047107 A1 * | 4/2008 | E21B 47/00 |

OTHER PUBLICATIONS

Jutten et al., "Relationship Between Cement Slurry Composition, Mechanical Properties, and Cement-Bond-Log Output," SPE Production Engineering, Feb. 1989, pp. 75-82.

(Continued)

*Primary Examiner* — James Sayre

(74) *Attorney, Agent, or Firm* — Edward T. Mickelson; John E. Vick

(57) ABSTRACT

The present invention is directed to methods and systems for obtaining log data on a cased wellbore concurrently with wellbore cleanout operations. In some such embodiments, a combination of at least one cleaning means and at least one logging tool are integrated or otherwise affixed to a common workstring, such that both wellbore cleanout and logging operations can be accomplished without having to remove the workstring from the well between such operations. In some such embodiments, the one or more logging tool(s) transmit information about the cased wellbore to the surface wirelessly. In some or other such embodiments, such information is transmitted via cable, in real-time or in batch mode. In some or still other such embodiments, such information is stored in memory and accessed subsequent to the workstring being extracted from the wellbore.

12 Claims, 4 Drawing Sheets

(56) References Cited

U.S. PATENT DOCUMENTS

| | | | | |
|---|---|---|---|---|
| 4,757,479 | A * | 7/1988 | Masson et al. | 367/35 |
| 4,771,408 | A | 9/1988 | Kotlyar | |
| 5,262,452 | A | 11/1993 | Gopalkrishnan | |
| 5,346,007 | A | 9/1994 | Dillon et al. | |
| 5,419,397 | A | 5/1995 | Reynolds et al. | |
| 5,570,742 | A | 11/1996 | Reynolds et al. | |
| 5,904,208 | A * | 5/1999 | Ray et al. | 166/312 |
| 6,173,606 | B1 * | 1/2001 | Mosley | 73/152.16 |
| 6,401,813 | B1 * | 6/2002 | Carmichael et al. | 166/173 |
| 6,421,298 | B1 | 7/2002 | Beattie et al. | |
| 6,758,276 | B2 * | 7/2004 | Reynolds | 166/312 |
| 6,766,141 | B1 * | 7/2004 | Briles et al. | 455/40 |
| 7,530,737 | B2 | 5/2009 | Thompson et al. | |
| 7,636,052 | B2 | 12/2009 | Coates et al. | |
| 2002/0157829 | A1 * | 10/2002 | Davis et al. | 166/297 |
| 2007/0131417 | A1 * | 6/2007 | Bolshakov et al. | 166/250.13 |
| 2008/0061789 | A1 | 3/2008 | Coates et al. | |
| 2009/0031796 | A1 | 2/2009 | Coates et al. | |
| 2010/0096187 | A1 * | 4/2010 | Storm et al. | 175/50 |

OTHER PUBLICATIONS

Graham et al., "Cement Evaluation and Casing Inspection With Advanced Ultrasonic Scanning Methods," Society of Petroleum Engineers, Annual Technical Conference Paper No. 38651. Oct. 1997.

International Search Report for International Patent Application No. PCT/US2011/028152 dated Sep. 26, 2011, 3 pages.

* cited by examiner

SYSTEMS AND METHODS FOR LOGGING CASED WELLBORES

FIELD OF THE INVENTION

This invention relates generally to drilling and completion operations, and specifically to systems and methods for obtaining various types of log data on a cased wellbore.

BACKGROUND

Numerous situations and/or scenarios exist in which wells are extended to subterranean locations in the earth's crust. For example, wells are drilled into subterranean formations in order to provide for the production of a variety of fluids, such as water, gas and/or oil; or for the injection of fluids, such as is employed in the secondary and tertiary recovery of oil (e.g., enhanced oil recovery). In many such situations and/or scenarios, in order to properly support the wall of the well, and possibly to exclude fluids from undesirably traversing the boundaries of at least some portions of the well, the well is cased with one or more strings of pipe, i.e., casing strings.

After a well has been drilled, the drillstring is withdrawn from the well and casing string is run into the well. Once the casing string is landed, the well is often conditioned by running a workstring into the well and circulating drilling fluid (i.e., mud) through the well to remove any residual drill cuttings. See, e.g., well completion operations such as described in any of the following: Peters, U.S. Pat. No. 3,455,387, issued Jul. 15, 1969; Kinney, U.S. Pat. No. 4,372,384, issued Feb. 8, 1983; Dillon et al., U.S. Pat. No. 5,346,007, issued Sep. 13, 1994; and Koplin, U.S. Pat. No. 3,312,280. Additionally or alternatively, wall scratchers are often run on the exterior of the casing string in order to scrape filter cake off the sides of the well wall in preparation for cementing (vide infra).

In order to complete the well, the casing must be bonded to the formation using a cementing procedure. Cementing procedures typically involve a drilling fluid displacement step, followed by a step of pumping a cement formulation (as a slurry) through the casing to the bottom of the well and then upwardly through the annular space between the outer surface of the casing and the surrounding wall structure, i.e., the formation. After the cement formulation is in place, it is allowed to set, thereby forming an impermeable sheath which, assuming that good bonding is established between the cement and the formation, and the cement and the casing, such bonding prevents the migration of fluids through the annulus surrounding the casing. The cement bonds further enhance the overall integrity of the well. For an example of a well cementing procedure, see, e.g., Parker, U.S. Pat. No. 3,799,874, issued Mar. 26, 1974.

Numerous cement formulations have been devised for a variety of applications and environmental conditions, but most are formulated with a desire to achieve adequate bonding at the interfaces of cement-formation wall and cement-casing. It is also desirable that such adequate bonding be uniformly established after a reasonable set or cure time, and that it endure for a sufficient period of time after the well has been completed and production begun. For examples of cement formulations used in the completion of oil and gas wells, see, e.g. Childs et al., U.S. Pat. No. 4,149,900, issued Apr. 17, 1979; Childs et al., U.S. Pat. No. 4,120,736, issued Oct. 17, 1978; Gallus, U.S. Pat. No. 4,069,870, issued Jan. 24, 1978; Gopalkrishnan, U.S. Pat. No. 5,262,452, issued Nov. 16, 1993; and Powers et al., U.S. Pat. No. 4,036,301, issued Jul. 19, 1977.

Notwithstanding the aforementioned desired characteristics of cement-derived bonding, bonding problems may nevertheless be encountered at the interface between the cement and the outer surface of the casing and the interface between the cement and the surrounding wall structure. This latter problem is particularly serious where the interface is provided by the wall of the well, i.e., the face of the formation exposed in the well. Accordingly, this interfacial bonding is typically evaluated prior to commencing with production.

To evaluate the cement bond to both the formation and the casing, a cement bond logging (CBL) procedure is used. Such procedures generally involve introducing into the well one or more tools as a package or sonde, wherein such a tool package or sonde is typically run up and down the well on a wireline. Most often, the cement bond logging tool associated with the sonde involves an acoustic means of interrogating the cement bond, whereby a sonic signal is produced and directed at the cement bond, and whereby one or more receivers and/or transducers receive a reflected signal that can be correlated with mechanical properties of the cement. See, e.g., Masson et al., U.S. Pat. No. 4,757,479, issued Jul. 12, 1988; Carmichael et al., U.S. Pat. No. 4,551,823, issued Nov. 5, 1985; and Jutten et al., "Relationship Between Cement Slurry Composition, Mechanical Properties, and Cement-Bond-Log Output," SPE Production Engineering, February, 1989, pp. 75-82.

In addition to the above-mentioned CBL operations, logs are also typically run to ascertain structural integrity and geometry (e.g., pipe eccentricity) of the casing string along the length of the wellbore, as the geometry of the tubing can change during deployment operations. This type of log is often carried out concurrently with the CBL operations. See, e.g., Graham et al., "Cement Evaluation and Casing Inspection With Advanced Ultrasonic Scanning Methods," Society of Petroleum Engineers, Annual Technical Conference Paper No. 38651, October 1997.

After cementing the casing in a well, one or more cleanout operations or procedures are typically employed to clean out the well in preparation for production. Such procedures can vary considerably, but often involve running a workstring down the well with one or more cleaning tools and/or devices attached to it. Such cleaning tools can include brushes, scrapers, drill bits (e.g., for drilling out cement plugs, etc.), and means for delivering (and circulating) fluids and/or chemicals to the wellbore for the purpose of cleaning out the cased wellbore (including cleaning of the drilling fluid contained therein) and/or the interior surfaces of the associated casing prior to drilling fluid displacement, perforation and subsequent production. See, e.g., Reynolds et al., U.S. Pat. No. 5,570,742, issued Nov. 5, 1996; Reynolds et al., U.S. Pat. No. 5,419,397, issued May 30, 1995; Reynolds, U.S. Pat. No. 6,758,276, issued Jul. 6, 2004; and Carmichael et al., U.S. Pat. No. 6,401,813, issued Jun. 11, 2002.

After such above-described cleanup operations, the drilling fluid present in the wellbore must be displaced by completion fluid, i.e., a displacement operation or procedure. However, the aforementioned cement bond logging is typically done in a separate step between the cleanup operations and the displacement operations. This requires removal of the workstring and the deployment of a sonde into the well on a wireline (vide supra).

While the abovementioned cement bond logging methods and cleanup procedures work adequately and ensure well integrity and well cleanliness before production begins, they require the steps of running a workstring down the well and, separately, running a wireline down the hole. This extra step of running a wireline (separately from the workstring)

equates to considerable time expenditures that are justifiable, most identifiably, by the assurance such testing affords.

In view of the foregoing, an improved method and/or system for cement bond logging (and for logging/evaluating other aspects of the well casing and/or surrounding formation) and wellbore integrity assessments would be extremely useful—particularly wherein such a method and/or system provides greater efficiency with respect to completions operations. Furthermore, while the discussion which follows focuses primarily on oil and gas wells, those of skill in the art will appreciate that at least some of the method and system embodiments discussed herein can be extended to a variety of the situations/scenarios mentioned above.

BRIEF DESCRIPTION OF THE INVENTION

The present invention is directed to methods and systems for obtaining log data on a cased wellbore concurrently with cased wellbore cleanout (and/or displacement) operations. In some such embodiments, a combination of at least one cleaning means and at least one logging tool are integrated or otherwise affixed to a common workstring, such that both cleanout and logging operations can be accomplished without having to remove the workstring from the well between such operations. In some such embodiments, the one or more logging tool(s) transmit information about the cased wellbore to the surface wirelessly. In some or other such embodiments, such information is transmitted via cable, in real-time or in batch mode. In some or still other such embodiments, such information is stored in memory and accessed subsequent to the workstring being extracted from the wellbore.

In some embodiments, the present invention is directed to one or more methods for acquiring log data on a cased wellbore, said one or more methods comprising the steps of: (a) deploying a workstring in a cased wellbore, wherein said workstring comprises one or more cleaning means operable for cleaning out said cased wellbore, and wherein said workstring comprise's one or more logging tools; (b) using the one or more cleaning means to clean an interior portion of the cased wellbore; (c) using the one or more logging tools to obtain information about the integrity of the cased wellbore; and (d) extracting the workstring from the cased wellbore, wherein logging data on the integrity of the cased wellbore is acquired concurrent to cased wellbore cleanout operations, thereby obviating the need to log the cased wellbore in a subsequent step after the workstring has been extracted from the cased wellbore.

In some embodiments, the present invention is directed to one or more systems for acquiring log data on a cased wellbore, said system comprising: (a) a cased wellbore; (b) a workstring operable for deployment in, and extraction from, the cased wellbore; (c) one or more cleaning means functionally associated with the workstring so as to provide for wellbore cleanout operations while the workstring is deployed in the cased wellbore; and (d) one or more logging tools configured so as to be associable with said workstring, wherein said one or more logging tools are utilized for obtaining information about the cased wellbore concurrent with said cased wellbore cleanout operations.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF THE INVENTION

1. Introduction

Figure 1:
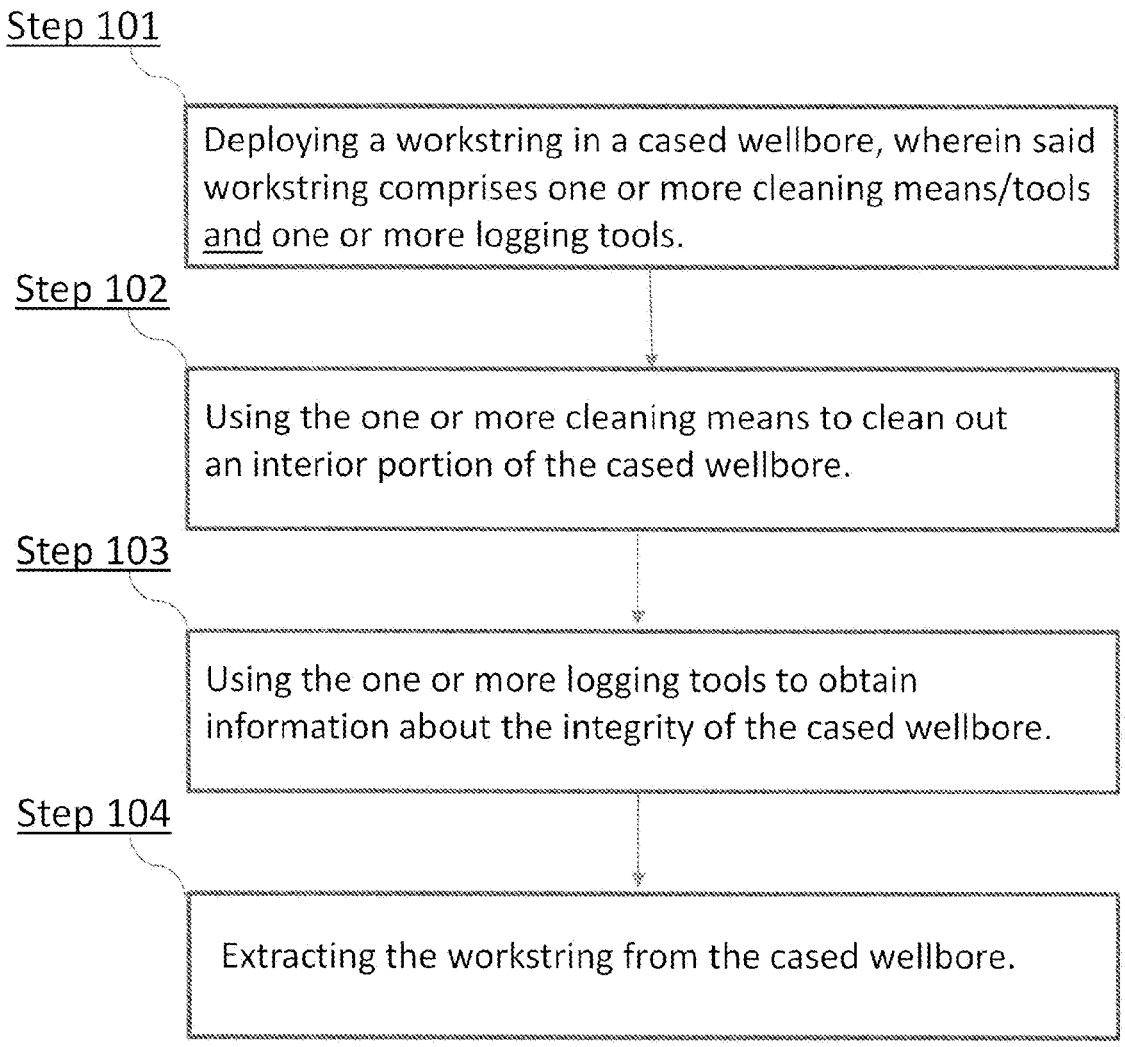
FIG. 1 illustrates, in stepwise fashion, one or more methods for acquiring log data on a cased wellbore, in accordance with some embodiments of the present invention.

The present invention is directed to methods and systems for obtaining log data on a cased wellbore concurrently with wellbore cleanout operations. In some such embodiments, a combination of at least one cleaning means (or tool) and at least one logging tool are integrated or otherwise affixed to a common workstring, such that both wellbore cleanout and logging operations can be accomplished without having to remove the workstring from the well between such operations. In some such embodiments, the one or more logging tool(s) transmit information about the cased wellbore to the surface wirelessly. In some or other such embodiments, such information is transmitted via cable, in real-time or in batch mode. In some or still other such embodiments, such information is stored in memory and accessed subsequent to the workstring being extracted from the wellbore.

2. Definitions

Certain terms are defined throughout this description as they are first used, while certain other terms used in this description are defined below:

A "cased wellbore," as defined herein, refers to a wellbore into which one or more casing strings have been run and cemented into place. This definition is extended to include one or more liner strings (in place of casing strings), wherein such liner strings are suspended at various depths via one or more liner hangers.

The term "cased wellbore cleanout," as used herein, refers to completions operation that follows cementing of casing in a wellbore. In such an operation, residual cement and other debris is removed from the interior of the cased wellbore, and the drilling fluid contained within the wellbore is cleaned by circulation of clean drilling fluid through the well.

The term "logging," as defined herein and as applied to cased wellbores, refers to the collection of information about the cased wellbore that independently and/or collectively assess the integrity of said wellbore.

A "workstring," as defined herein, is a string of tubulars deployed in a subterranean wellbore for the purpose of performing tasks during the course of drilling and/or completion operations.

A "bottom hole assembly" or "BHA," as defined herein, refers to the region, joint, or segment (at the bottom) of a workstring responsible for activities at or near the well bottom. In drilling operations, the BHA on a drill string comprises a drill bit and often drill collars. For wellbore cleanout operations, the BHA often comprises a used drill bit.

"Wellbore integrity," as defined herein, refers to a state or condition in which a wellbore can be reliably expected to function in the production of hydrocarbons (or other fluids) from subsurface reservoirs. Such wellbore integrity is a function of the casing material and geometry, the bonding between the casing/cement and cement/formation interfaces, and various other environmental conditions.

The term "pipe ovality," as used herein, refers to deviations from circular pipe uniformity, wherein such deviations typically result from deployment of said pipe into a subsurface well. "Casing ovality" is synonymous, but for casing tubular.

The term "pipe eccentricity," as defined herein, refers to an extent to which pipe in a well is not centrally nested within said well. "Casing eccentricity" is generally synonymous, but refers specifically to casing tubulars (a subset of generic pipe).

3. Methods

As mentioned previously herein (vide supra), methods of the present invention provide for the obtaining of log data on a cased wellbore concurrently with cased wellbore cleanout operations. Such methods eliminate the need for a sonde-based well log, wherein the sonde is run on a wireline independently of a workstring (i.e., the workstring must be withdrawn from the well before the sonde is deployed).

With reference to FIG. 1, in some embodiments the present invention is directed to one or more methods for acquiring log data on a cased wellbore, said one or more methods comprising the steps of: (Step 101) deploying a workstring in a cased wellbore, wherein said workstring comprises one or more cleaning means/tools operable for cleaning out said cased wellbore, and wherein said workstring comprises one or more logging tools; (Step 102) using the one or more cleaning means to clean out an interior portion of the cased wellbore; (Step 103) using the one or more logging tools to obtain information about the integrity of the cased wellbore; and (Step 104) extracting the workstring from the cased wellbore, wherein logging data on the integrity of the cased wellbore is acquired concurrent to cased wellbore cleanout operations, thereby obviating the need to log the cased wellbore in a step subsequent to the workstring having been extracted from the cased wellbore.

Regarding such above-described method embodiments, the type of cased well to which it is applied is not particularly limited. Accordingly, such wells can be vertical, deviated, or horizontal, or combinations thereof. Such wells can be capable of producing oil, gas, and/or other fluids (vide supra). Such wells are also contemplated to be injection wells operable for stimulating production (e.g., steam injection). Similarly, the wells can be onshore or offshore, and in the latter case, they can be in either shallow or deepwater. Furthermore, the wells can vary considerably over a wide range of depths and/or lengths, and the methods can typically be tailored so as to accommodate the particular procedures unique to any or all of such wells.

In some such above-mentioned method embodiments, the acquired log data comprises well integrity information selected from the group consisting of pipe wall thickness (i.e., pipe thickness conformance), casing eccentricity, casing ovality, casing-cement bond, cement-formation bond, cement sheath thickness and variation, and any combination(s) thereof. In some such embodiments, the log data is generated via one or more logging tools (affixed or otherwise associated with the workstring), wherein the one or more logging tools are selected from the group consisting of sonic-based devices, mechanical devices (e.g., calipers), electromagnetic devices, gamma (γ) ray detector, acoustic detection devices, and combinations thereof.

In some such above-mentioned method embodiments, the one or more logging tools are affixed to the workstring in one or more locations suitable for collecting log data in one or more regions of interest within the cased wellbore, and wherein the one or more logging tools are located in a relative position selected from the group consisting of eccentric (i.e., not centralized) to the casing, central to the casing, or combinations thereof.

In some such above-mentioned method embodiments, at least one of the one or more logging tools is affixed to, or integrated with, the workstring in such a way so as to be positioned beneath (e.g., hang below) said workstring. In some such embodiments, the one or more logging tools are part of the bottom hole assembly (BHA). In some or other embodiments, the workstring comprises a BHA (or a portion thereof) that can be sacrificed to allow at least one of the one or more logging tools to be deployed or otherwise extended from/out of the bottom of the workstring.

In some such above-mentioned method embodiments, at least one of the one or more logging tools is affixed to an interior surface of the workstring. In some such embodiments, there may be a recessed portion of the workstring pipe (possibly a "sub") in which the at least one such logging tool resides, and/or there may be one or more coverings and/or other devices to protect any or all of said logging tools. In some or other embodiments, at least one of the one or more logging tools is affixed to an exterior of the workstring. In such latter instances, the one or more tools can be affixed directly to the workstring's exterior pipe and/or in a recessed portion thereof. Where affixation is in a recessed portion of said workstring pipe, the one or more tools can still be allowed to protrude out beyond the workstring pipe outer diameter (OD).

Log data acquisition can be carried out under any one of a number of scenarios. Such log data acquisition can be carried out in continuous or batch mode, or a combination of the two. The log data can be acquired in real time and/or stored in memory for subsequent retrieval. Additionally, such data acquisition can be done in a manner such that it can be seen to "guide" the well cleanout operations.

In some such above-mentioned method embodiments, log data is obtained during movement of the workstring relative to the cased wellbore. In some such embodiments, log data is obtained as the workstring is being extracted from the wellbore. In some or other such embodiments, log data is obtained as the workstring is being introduced into the wellbore. In some or still other such embodiments, log data is obtained as the workstring is cycled up and down in the wellbore.

In some such above-mentioned method embodiments, log data is obtained in real time. In some such embodiments, log data is transmitted to the surface via a cabled means. Additionally or alternatively, in some such above-mentioned method embodiments, log data is transmitted to the surface via wireless means. In some instances regarding such latter embodiments, data is retrieved from the well in a form selected from the group consisting of pressure pulses, acoustic transmissions, electromagnetic (EM) transmissions, and combinations thereof.

In some embodiments, where wireless transmission of data is relied upon, such wireless transmission of data can be at least partially provided by mud-based telemetry methods. Such techniques are known in the art and will not be described here in further detail. For examples of such mud-based telemetry methods, see, e.g., Kotlyar, U.S. Pat. No. 4,771,408, issued Sep. 13, 1988; and Beattie et al., U.S. Pat. No. 6,421,298, issued Jul. 16, 2002.

In some embodiments, EM transmissions of a type described in, for example, Briles et al., U.S. Pat. No. 6,766,141, issued Jul. 20, 2004, are used to transmit data into and out of the cased wellbore. The downhole resonant circuits used in such methods and systems can be integrated directly or indirectly with the one or more logging tools, so as to convey information into, and out of, the well. See also, e.g., Coates et al., U.S. Pat. No. 7,636,052, issued Dec. 22, 2009; Thompson et al., U.S. Pat. No. 7,530,737, issued May 12, 2009; Coates et al., U.S. Patent Appl. Pub. No. 20090031796, published Feb. 5, 2009; and Coates et al., U.S. Patent Appl. Pub. No. 20080061789, published Mar. 13, 2008, wherein such "infinite communication" systems and methods are referred to hereinafter as "INFICOMM."

In some such above-mentioned method embodiments, log data is collected and stored in memory. Such memory storage of data is not particularly limited (hard drives, flash drives, optical drives, etc.), but must generally be able to withstand the environmental conditions present downhole. In some cases, storage containers can be configured to afford such memory drives protection from adverse downhole environments. Additionally or alternatively, in some embodiments the memory storage device is positioned uphole from the sensors, and data transmission between the sensor and the storage device occurs via cabled and/or wireless means. In some embodiments, the memory storage is at the surface.

4. System

System embodiments of the present invention typically describe, in functional terms, the infrastructure required to implement a corresponding method embodiment of the present invention. Accordingly, system embodiments described in this section generally correspond in a substantial manner with the method embodiments described above in Section 3.

Figure 2:
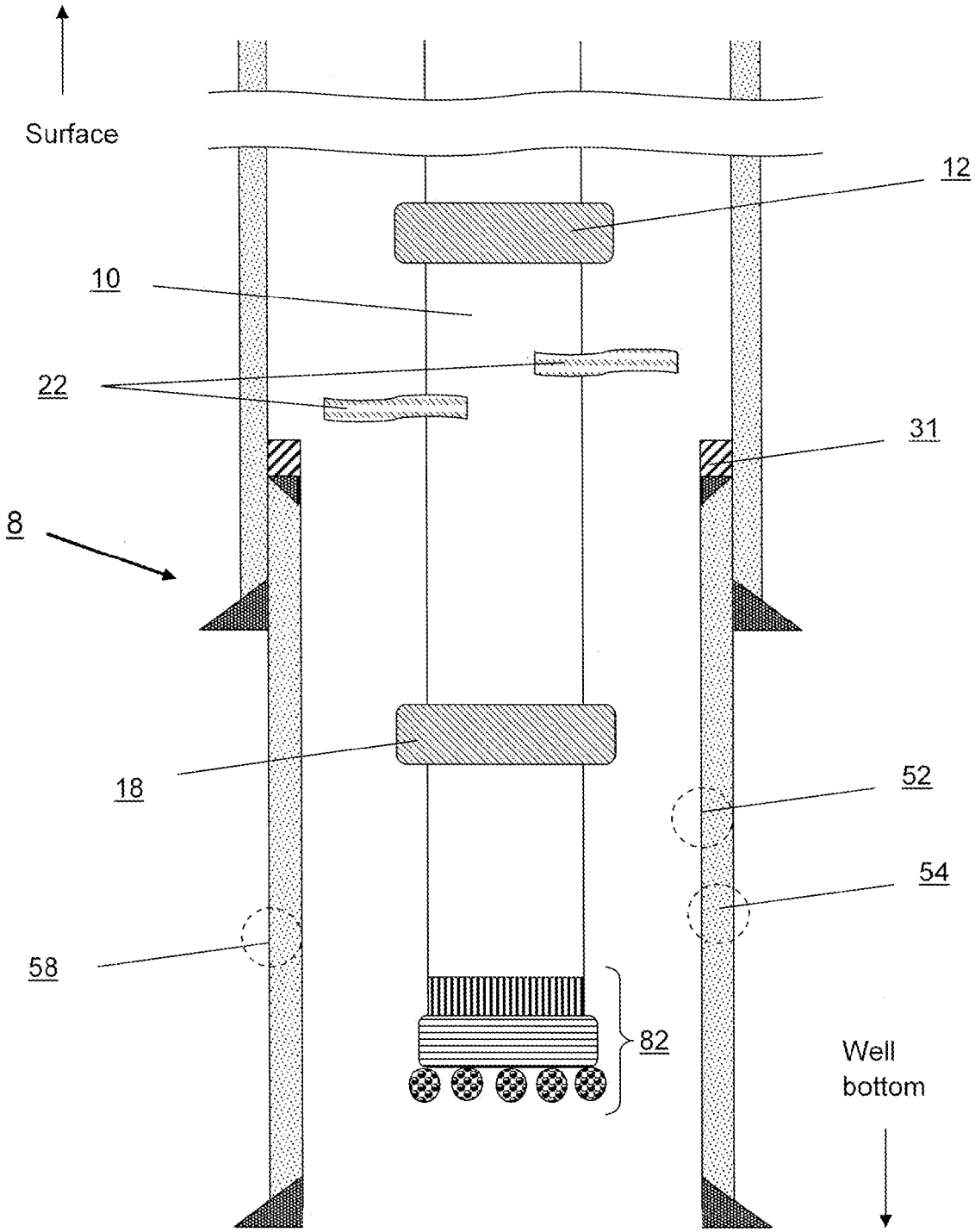
FIG. 2 depicts a system for acquiring log data on a cased wellbore, wherein the one or more logging tools are affixed to a portion of the workstring, in accordance with some embodiments of the present invention.

FIG. 2 depicts a system for acquiring log data on a cased wellbore, wherein the one or more logging tools are affixed to a portion of the workstring, in accordance with some embodiments of the present invention. In the discussion which follows, FIG. 2 will be used to facilitate the understanding of the system elements and their various interrelationships, but it should be understood that the system depicted in FIG. 2 is merely exemplary and that reference made thereto is largely for illustrative purposes. It should be further appreciated that the relative size and positioning of various components shown in the system illustrated in FIG. 2 are also for illustrative purposes, and not necessarily reflective of what is encountered in the field.

Referring now to FIG. 2, in some embodiments the present invention is directed to one or more systems for acquiring log data on a cased wellbore, said system comprising: (a) a cased wellbore 8; (b) a workstring 10 operable for deployment in, and extraction from, the cased wellbore 8; (c) one or more cleaning means 22 functionally associated with the workstring 10 so as to provide for wellbore cleanout operations while the workstring is deployed in the cased wellbore; and (d) one or more logging tools (12 and 18) configured so as to be associable with said workstring 10, wherein said one or more logging tools are utilized for obtaining information about the cased wellbore concurrent with said cased wellbore cleanout operations.

Referring still to FIG. 2, it is noted that cased wellbore 8 comprises casing joints 52 run into the well and bonded to the formation 58 with cement formulation 54. Additionally, at locations in the well that undergo a reduction in casing diameter, the smaller diameter casing can be suspended from the larger diameter casing via hangers 31. BHA 82 is shown at the terminal point on workstring 10.

In some such above-described system embodiments, the one or more logging tools selected from the group consisting of sonic-based devices, mechanical devices (e.g., calipers), electromagnetic devices, gamma (γ) ray detectors, acoustic detection devices, and any combination(s) thereof.

In some such above-described system embodiments, the one or more logging tools are affixed to, or otherwise associated with, the workstring in one or more locations suitable for collecting log data in one or more regions of interest within the cased wellbore, and wherein the one or more logging tools are located in a position (relative to the casing) selected from the group consisting of eccentric to the casing, central to the casing, or combinations thereof.

In some such above-described system embodiments, at least one of the one or more logging tools are affixed to, or otherwise associated with, the workstring in such a way so as to be positioned beneath (e.g., hang below) said workstring. In some such embodiments, a deployment means is integrated into system so as to effect the deployment of the at least one logging tool to its position beneath the workstring—while the workstring is positioned in the well. A number of possible deployment means are presently contemplated including, but not limited to, mechanical actuation, thermal actuation, hydraulic actuation, explosive actuation, electronic actuation, wireless or cabled means of any such means, and combinations thereof.

Figure 3A:
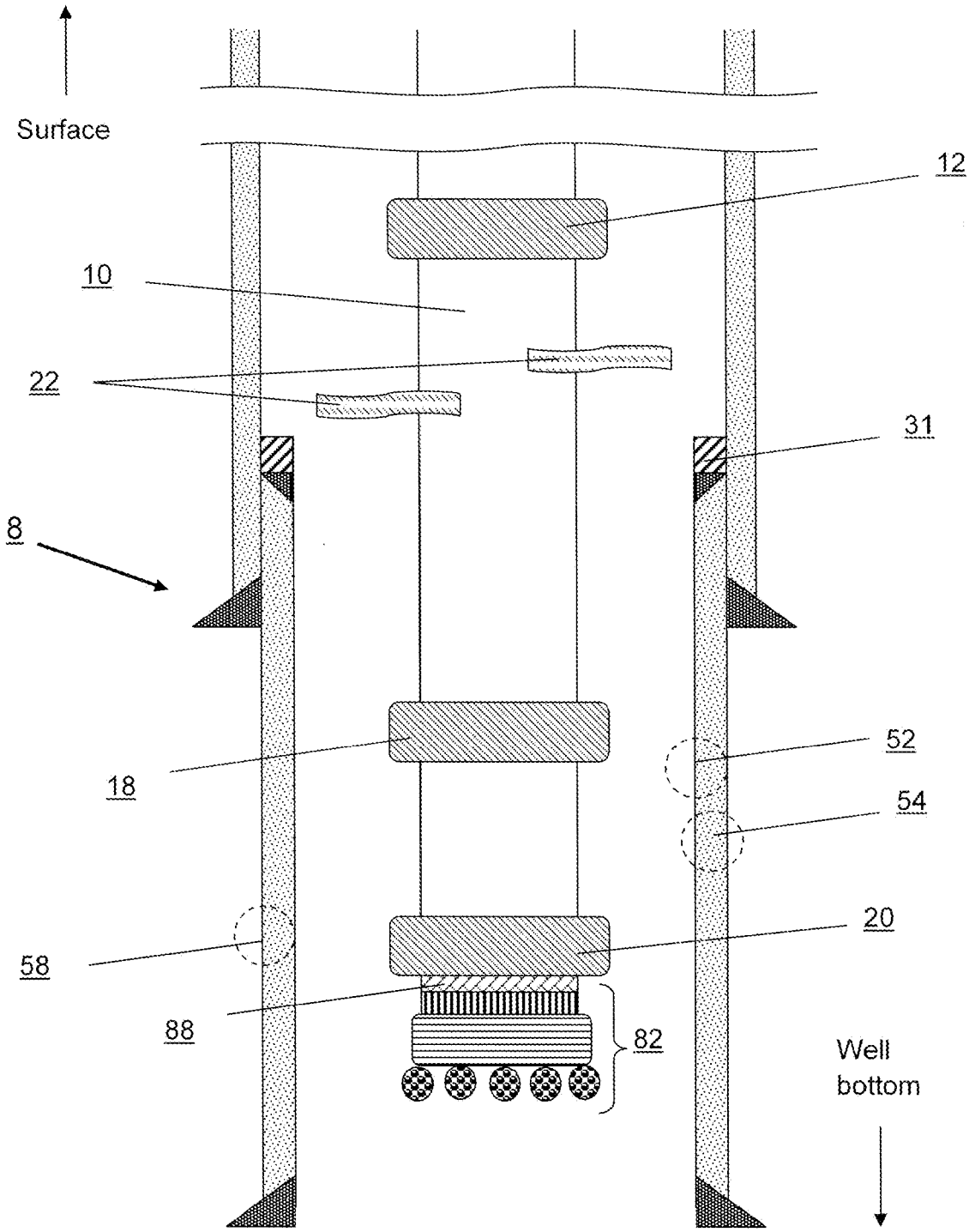
FIG. 3A depicts a system for acquiring log data on a cased wellbore, in accordance with some embodiments of the present invention, wherein the one or more logging tools are positioned behind the bottom hole assembly, the latter comprising a disengagement means.
Figure 3B:
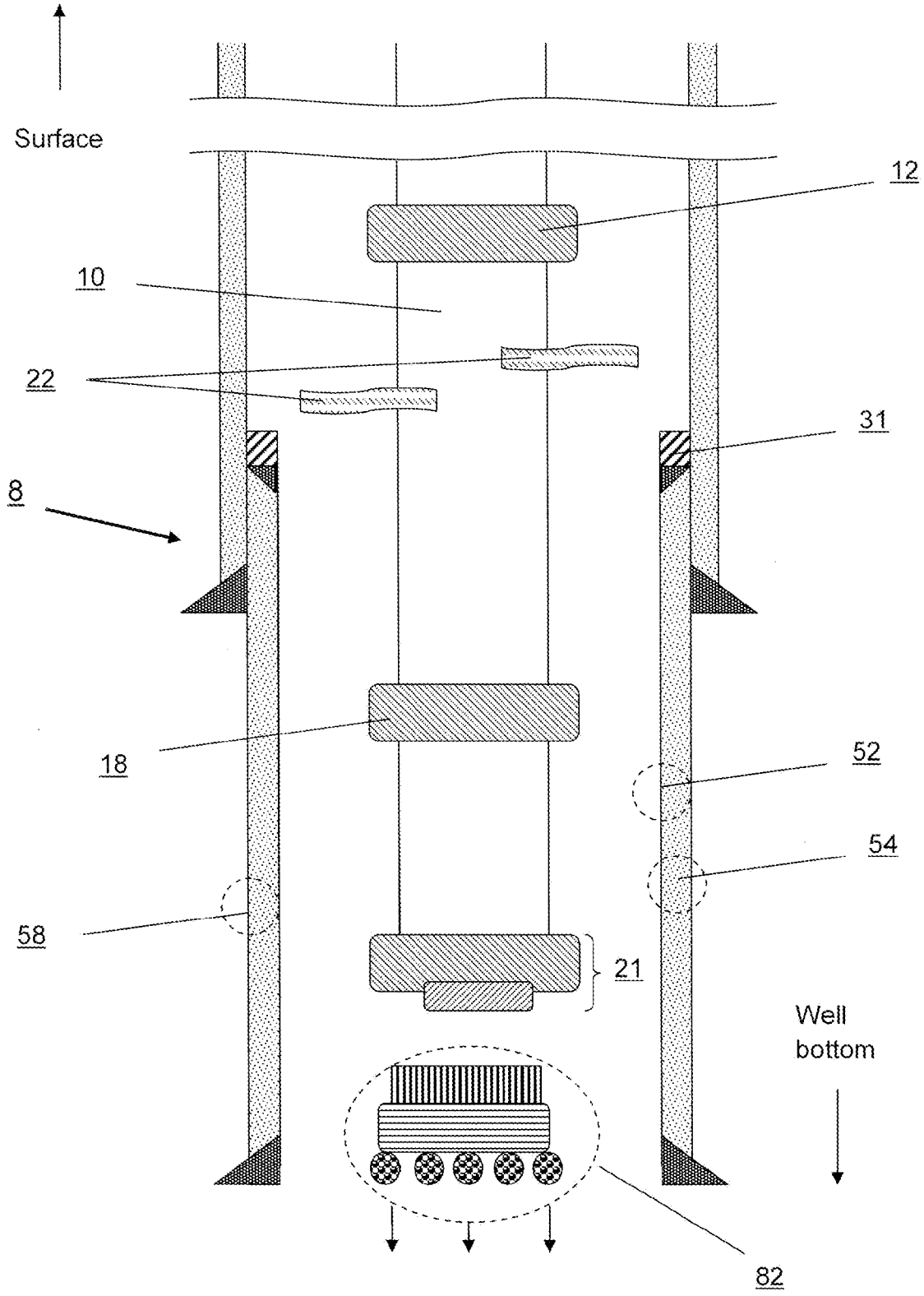
FIG. 3B depicts the system of FIG. 3A, but after the bottom hole assembly (or a portion thereof) has been disengaged and the logging tool deployed.

In a presently contemplated embodiment illustrated in FIGS. 3A and 3B, undeployed (FIG. 3A) logging tool 20 is situated behind BHA 82 and separated via deployment/disengagement means 88. Upon engaging the deployment means (FIG. 3B), BHA 82 drops to the bottom of the well and undeployed logging tool 20 is deployed as logging tool 21, wherein said deployed logging tool 21 can functionally operate with any or all of the logging and/or cleaning tools illustrated and/or described above.

In some such above-described system embodiments, at least one of the one or more logging tools is affixed to an interior region or surface of the workstring. Additionally or alternatively, in some or other such system embodiments, at least one of the one or more logging tools is affixed to an exterior surface or region of the workstring.

In some such above-described system embodiments, the information about the cased wellbore is selected from the group consisting of pipe wall thickness, pipe eccentricity, casing-cement bond, cement-formation bond, and combinations thereof.

Depending on the embodiment, such above-described system embodiments can comprise means for transmitting log data to the surface in real time and/or storing such data in memory for subsequent retrieval. Consistent with the associated method embodiments described above, such transmission of data to the surface (in real time) can occur via cabled means or via wireless means. In the latter such case, exemplary wireless communication means include, but are not limited to, mud-based telemetry and INFICOMM (vide supra).

5. Variations

While the aforementioned embodiments are generally directed to systems and methods for logging cased wellbores in conjunction with well cleanout operations, variational embodiments include systems and methods for doing same concurrently with displacement operations.

6. Summary

As described throughout, the present invention is directed to systems and methods for obtaining log data on a cased wellbore concurrently with wellbore cleanout (completion) operations. In some such embodiments, a combination of at least one cleaning means and at least one logging tool are integrated or otherwise affixed to a common workstring, such that both wellbore cleanout and logging operations can be accomplished without having to remove the workstring from the well between such operations. Such systems and methods generally eliminate the need to extract the workstring from the wellbore and separately deploy a sonde (run down the well on a wireline) to evaluate the cased wellbore. In some such embodiments, the one or more logging tool(s) transmit information about the cased wellbore to the surface wirelessly. In some or other such embodiments, such information is transmitted via cable, in real-time or in batch mode. In some or still other such embodiments, such information is stored in memory and accessed subsequent to the workstring being extracted from the wellbore.

All patents and publications referenced herein are hereby incorporated by reference to an extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A method for acquiring and transmitting log data, said method comprising the steps of:

a) deploying a workstring in a cased wellbore, wherein said workstring comprises one or more cleaning means operable for cleaning out said cased wellbore, the workstring further comprising a sacrificial bottom hole assembly (BHA) being configured to be releasable from the workstring, wherein said workstring further comprises one or more logging tools affixed at least partially upon the interior of the workstring and separated from the BHA by a deployment/disengagement means, the one or more logging tools being adapted for deployment from the workstring;

b) using the one or more cleaning means to clean out an interior portion of the cased wellbore;

c) activating the deployment/disengagement means to release the BHA;

d) deploying one or more logging tools from the workstring, and then using the one or more logging tools to obtain information/data about the integrity of the cased wellbore while the logging tool is deployed and located beneath the workstring;

e) transmitting the information/data to the surface in real time by way of an infinite communication system, the infinite communication system being operable for wireless transmission of the information/data;

f) extracting the workstring from the cased wellbore; and wherein logging data on the integrity of the cased wellbore is acquired in a concurrent wellbore trip with cased wellbore cleanout operations, thereby obviating the necessity to log the cased wellbore in a subsequent step after the workstring has been extracted from the cased wellbore.

2. The method of claim 1, wherein the acquired log data comprises well integrity information selected from the group consisting of pipe wall thickness, pipe ovality, pipe eccentricity, casing-cement bond, cement-formation bond, and combinations thereof.

3. The method of claim 2, wherein the log data is generated with logging tools selected from the group consisting of sonic-based devices, mechanical devices, electromagnetic devices, gamma (γ) ray detectors, acoustic detection devices, and combinations thereof.

4. The method of claim 1, wherein the one or more logging tools are affixed to the workstring in one or more locations suitable for collecting log data in one or more regions of interest within the cased wellbore, and wherein the one or more logging tools are located in a relative position selected from the group consisting of eccentric to the casing, central to the casing, or combinations thereof.

5. The method of claim 1, wherein log data is obtained during movement of the workstring relative to the cased wellbore.

6. The method of claim 5, wherein movement of the workstring relative to the cased wellbore occurs in a manner selected from the group consisting of: (a) workstring extraction from the wellbore, (b) workstring introduction to the wellbore, and (c) combinations thereof.

7. The method of claim 1, wherein log data is obtained as the workstring is cycled up and down in the wellbore.

8. The method of claim 1, wherein the cased wellbore is a subsea well.

9. A system for acquiring log data in a cased wellbore, the system comprising:

a) a cased wellbore;

b) a workstring operable for deployment in, and extraction from, the cased wellbore, the workstring further comprising a sacrificial bottom hole assembly (BHA), the sacrificial bottom hole assembly being configured to be releasable from the workstring c) one or more cleaning means functionally associated with the workstring and sacrificial BHA so as to provide for wellbore cleanout operations while the workstring is deployed in the cased wellbore;

d) one or more logging tools affixed at least partially upon the interior of the workstring and positioned above and separated from the workstring by a deployment/disengagement means, wherein said one or more logging tools are adapted for deployment from the workstring and are utilized for obtaining information/data about the cased wellbore; and e) transmitting the information/data to the surface in real time by way of an infinite communication system, the infinite communication system being operable for wireless transmission of the information/data to the surface.

10. The system of claim 9, wherein the one or more logging tools selected from the group consisting of sonic-based devices, mechanical devices, electromagnetic devices, gamma ray detectors, acoustic detection devices, and combinations thereof.

11. The system of claim 9, wherein the one or more logging tools are affixed to the workstring in one or more locations suitable for collecting log data in one or more regions of interest within the cased wellbore, and wherein the one or more logging tools are located in a relative position selected from the group consisting of eccentric to the casing, central to the casing, or combinations thereof.

12. The system of claim 9, wherein the information about the cased wellbore is selected from the group consisting of pipe wall thickness, pipe eccentricity, pipe ovality, casing-cement bond, cement-formation bond, and combinations thereof.

* * * * *